US008032975B2

(12) United States Patent
Chiang

(10) Patent No.: US 8,032,975 B2
(45) Date of Patent: Oct. 11, 2011

(54) MOP

(76) Inventor: Hsiao-Hung Chiang, Taipei (TW)

( * ) Notice: Subject to any disclaimer, the term of this patent is extended or adjusted under 35 U.S.C. 154(b) by 395 days.

(21) Appl. No.: 12/431,765

(22) Filed: Apr. 29, 2009

(65) Prior Publication Data

US 2010/0139020 A1 Jun. 10, 2010

(30) Foreign Application Priority Data

Dec. 8, 2008 (TW) ..... 97221972 U

(51) Int. Cl.
*A47L 13/20* (2006.01)

(52) U.S. Cl. ..... 15/229.6; 15/144.1; 15/144.2; 15/147.1; 15/147.2; 15/229.1

(58) Field of Classification Search ..... 15/144.1, 15/144.2, 147.1, 147.2, 228, 229.1, 229.2, 15/229.6

See application file for complete search history.

(56) References Cited

U.S. PATENT DOCUMENTS

| | | | | |
|---|---|---|---|---|
| 1,169,958 | A * | 2/1916 | Hurt | 15/118 |
| 2,973,540 | A * | 3/1961 | Saenz | 15/229.6 |
| 4,245,368 | A * | 1/1981 | Cotey et al. | 15/229.2 |
| 7,540,057 | B2 * | 6/2009 | Lin et al. | 15/229.6 |

* cited by examiner

*Primary Examiner* — Mark Spisich

(57) ABSTRACT

A mop includes a handle comprising a plastic end joint comprising a downward protrusion and two shoulders; a rotatable cover comprising an annular trough, a central hole, and bottom latches; a hinge comprising a disc, a yoke, and a circular plate having slits wherein the yoke loosely passes the hole to pivotably secure to the joint with the latches contacting the disc and inserting through the slits to secure the circular plate, the disc, and the cover together, and the joint being disposed in the channel; and a strand mounting assembly comprising arcuate sections comprising two cross-shaped apertures having four sharp protuberance, and sets of strands. Each set of strands has one end fastened in the arcuate section after inserting through the aperture to be retained by the sharp protuberances.

5 Claims, 5 Drawing Sheets

MOP

CROSS-REFERENCE TO RELATED APPLICATIONS

This inventor had filed an application in the United States of America as patent application Ser. No. 12/241,042 on Sep. 30, 2008 which is incorporated herein by reference.

BACKGROUND OF THE INVENTION

1. Field of Invention

The invention relates to mops and more particularly to such a mop with an improved characteristics.

2. Description of Related Art

A conventional strand mounting assembly 6 is shown in FIG. 5. The strand mounting assembly 6 is shaped as a ring and comprises a plurality of apertures 61 equally spaced around a circumferential edge thereof. The aperture 61 has a reduced diameter section 62 open to the bottom. In an assembly process of the strand mounting assembly 6, a bundle of loose rags (not shown) is inserted through the reduced diameter section 62 into an upper portion of the aperture 61 prior to fastening.

But this is unsatisfactory for the purpose for which the invention is concerned for the following reasons:

The assembly process of the bundles of loose rags in the apertures 61 is low in efficiency. Further, the fastening of the bundles of loose rags in the apertures 61 is not reliable. Thus, the need for improvement still exists.

SUMMARY OF THE INVENTION

It is therefore one object of the invention to provide a mop comprising an elongate handle comprising a shank and a joint downward projecting from the shank, the joint being formed of plastic and comprising a downward protrusion and two shoulders each formed between either side of the joint and the shank; a rotatable cover comprising an annular trough on an underside, a central through hole, and a plurality of spaced apart latches disposed between the trough and the through hole; a hinge comprising a disc, a yoke having two opposite yoke arms projecting upward from the disc with a channel defined therebetween, two projections each formed on a top of the yoke arm, and a circular plate for containing the disc, the circular plate having a plurality of spaced apart slits adjacent a circumferential edge thereof wherein the yoke loosely passes the through hole to pivotably secure to the joint with the latches contacting a circumferential edge of the disc and inserting through the slits to secure the circular plate, the disc, and the cover together, and the joint being disposed in the channel; and a ring-shaped strand mounting assembly comprising a plurality of arcuate sections each comprising at least one aperture each having at least one sharp protuberance, and a plurality of sets of strands wherein each set of strands has one end fastened in the arcuate section after inserting through the aperture to be retained by the at least one sharp protuberance, the strand mounting assembly being secured to the cover by snapping the arcuate sections into the trough, wherein the protrusion is urged against a bottom of the channel, and the projections are urged against the shoulders when the handle stands upright; and the cover and the strand mounting assembly together are adapted to rotate about the yoke with both the handle and the yoke being motionless during the rotation.

The above and other objects, features and advantages of the invention will become apparent from the following detailed description taken with the accompanying drawings.

DETAILED DESCRIPTION OF THE INVENTION

Figure 1:
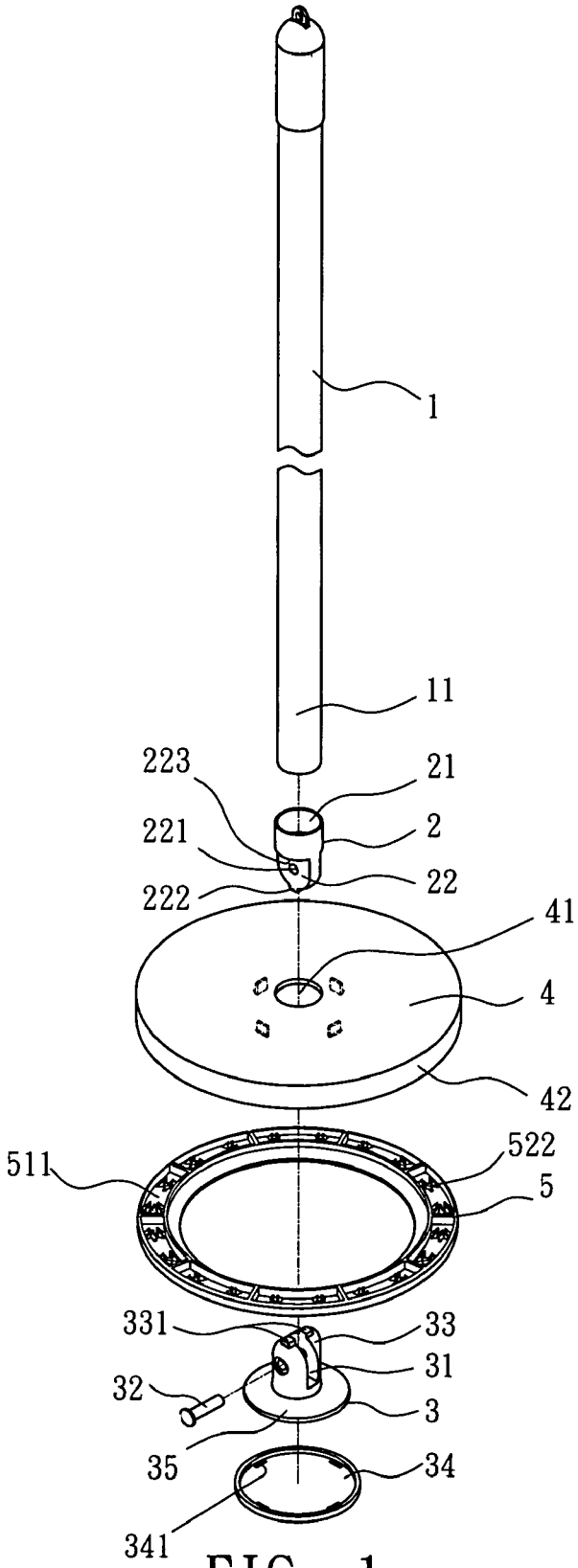
FIG. 1 is an exploded view of main components of a mop incorporating a preferred embodiment of strand mounting assembly according to the invention.
Figure 2:
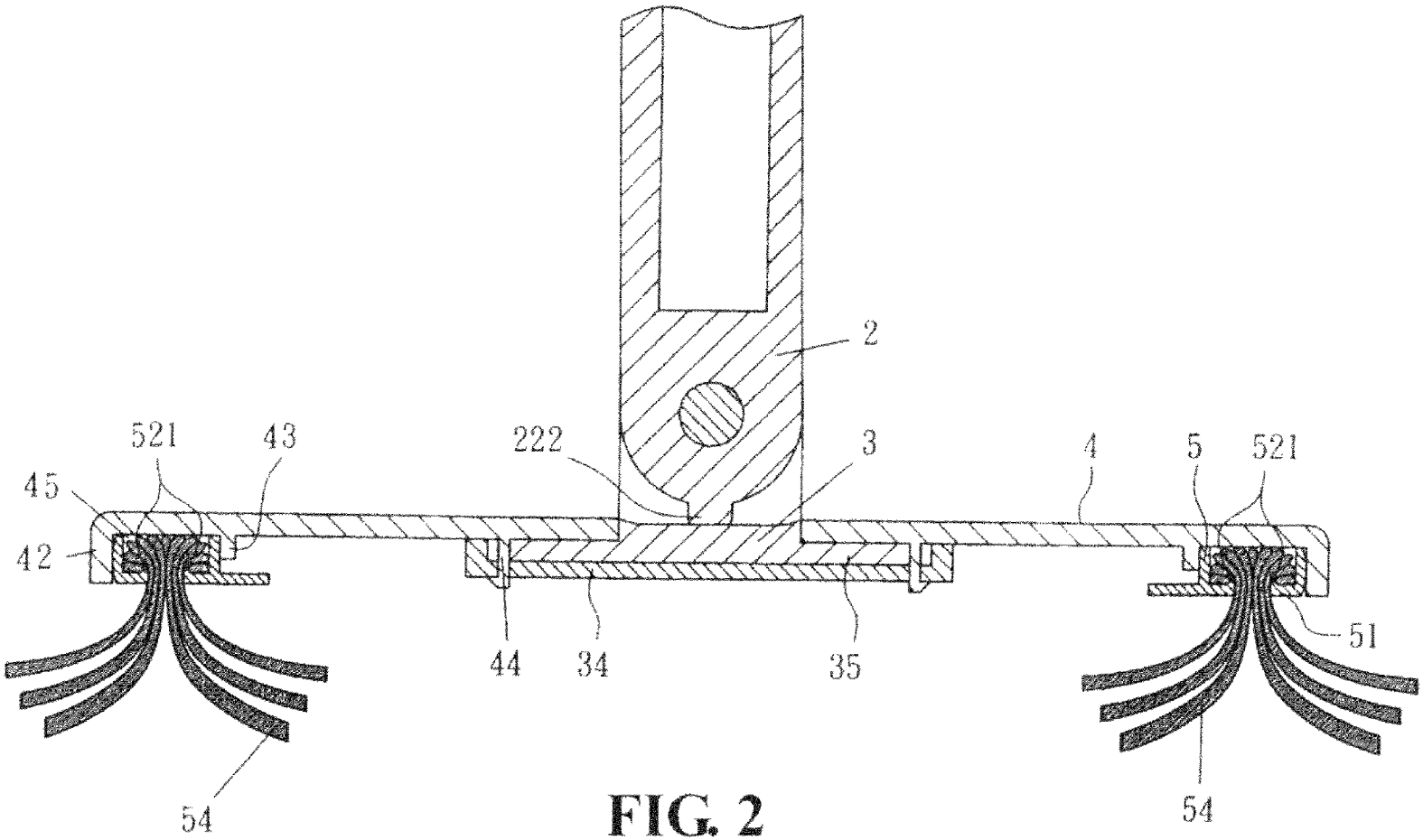
FIG. 2 is a longitudinal sectional view of a lower portion of the mop assembled with strands.
Figure 3:
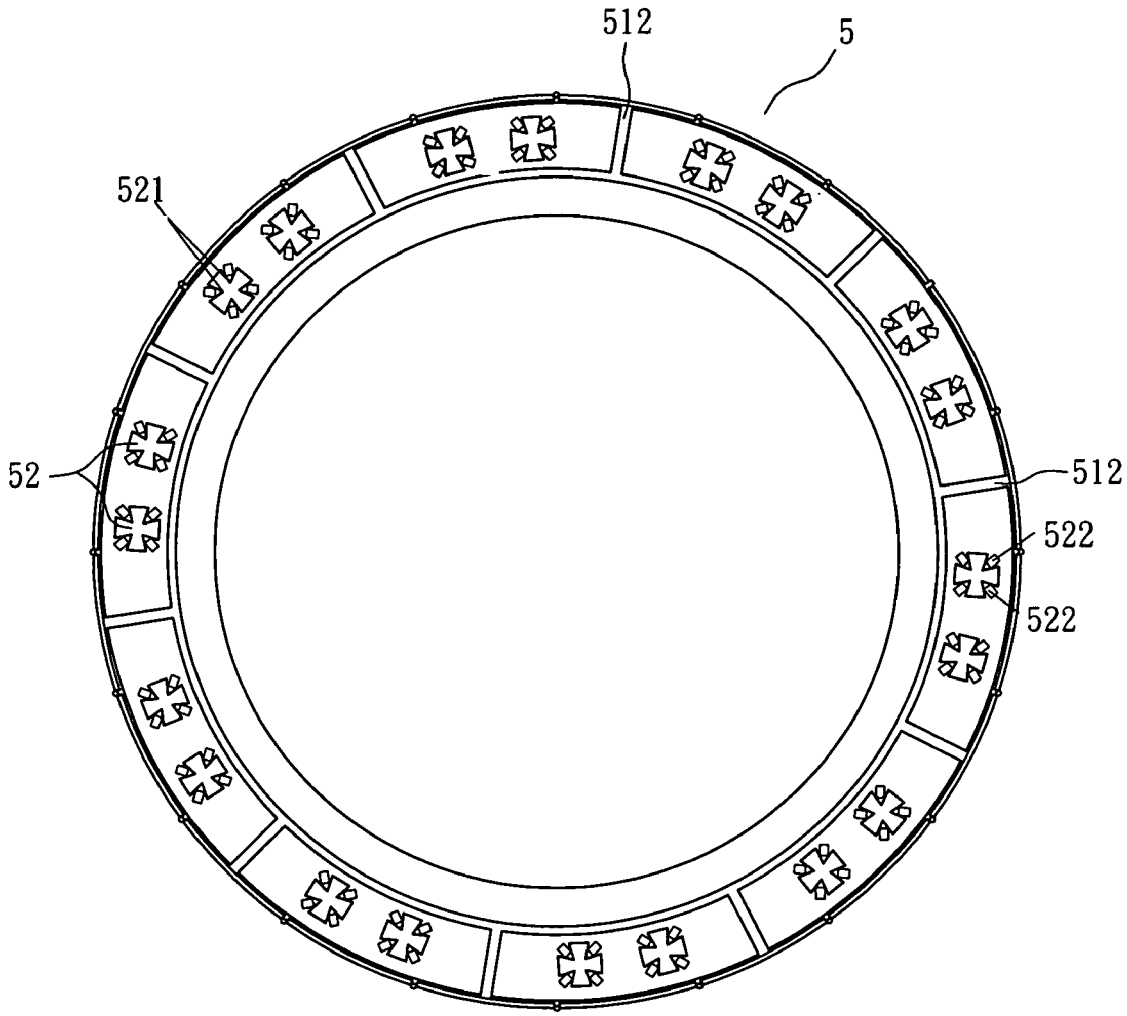
FIG. 3 is a top view of the strand mounting assembly with the strands being removed.
Figure 4:
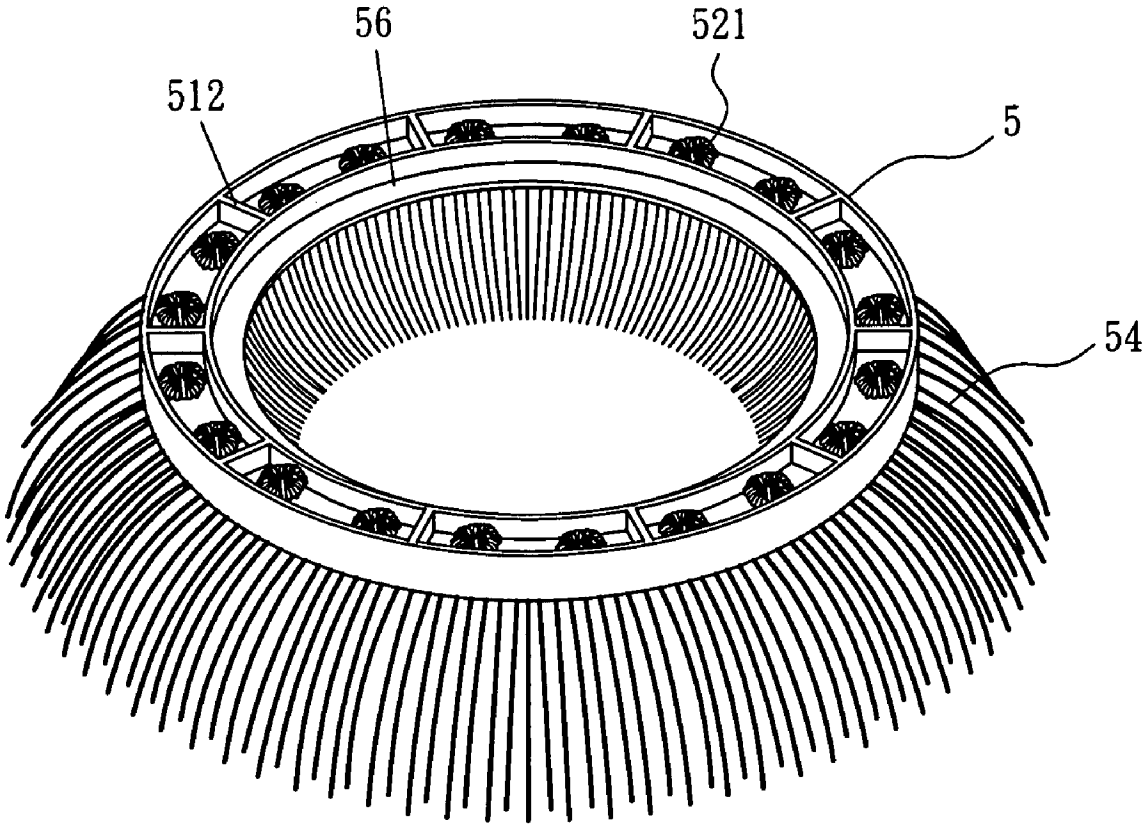
FIG. 4 is a perspective view of the strand mounting assembly assembled with the strands.
Figure 5:
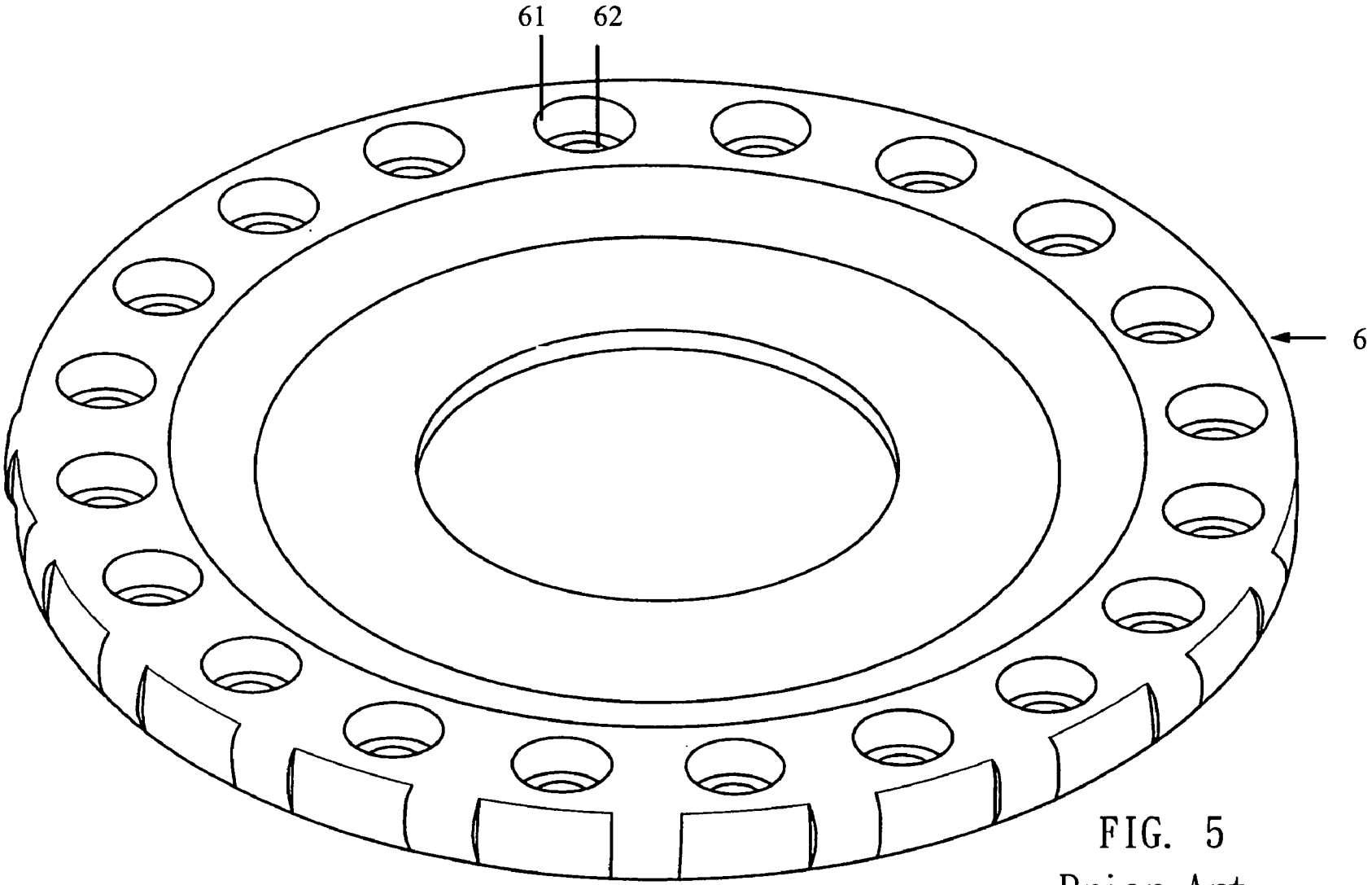
FIG. 5 Prior Art
FIG. 5 is a perspective view of a conventional strand mounting assembly.

Referring to FIGS. 1 to 4, a mop incorporating a preferred embodiment of strand mounting assembly according to the invention is shown. The mop comprises the following components as discussed in detail below.

An elongate handle 1 has a lower portion 11. A joint 2 is formed of plastic and comprises an upper sleeve 21 adapted to secure to the lower portion 11, and a projecting lower coupling 22 including a protrusion 222 on its lowest position, an intermediate transverse hole 221, and two shoulders 223 each formed between either side of the coupling 22 and the sleeve 21.

A rotatable cover 4 comprises a central through hole 41, a downward annular outer flange 42, a downward annular inner flange 43 with an annular trough 45 on the underside defined between the outer flange 42 and the inner flange 43, and a plurality of (e.g., four) equally spaced apart latches 44 on the underside between the inner flange 43 and the through hole 41.

A hinge 3 comprises a bottom disc 35, a yoke 33 having two opposite yoke arms (not numbered) projecting upward from the disc 35 with a channel 31 defined therebetween, two projections 331 each formed on the arc top of the yoke arm of the yoke 33, a pin 32, and a circular plate 34 having an upward annular flange (not numbered) and a plurality of (e.g., four) equally spaced apart slits 341 adjacent the flange thereof. The disc 35 is disposed in the circular plate 34. The yoke 33 is shaped to loosely pass the through hole 41 to engage the disc 35 with the underside of the cover 4. At the same time, the latches 44 contact and pass the circumferential edge of the disc 3 to insert through the slits 341 to secure the circular plate 34, the disc 35 and the cover 4 together. The coupling 22 is disposed in the channel 31 with the protrusion 222 urged against a flat bottom of the channel 31 when both the handle 1 and the joint 2 are upright (i.e., inoperative position). The pin 32 can be inserted through a through aperture (not numbered) of one yoke arm, the transverse hole 221, and a through aperture (not numbered) of the other yoke arm to pivotably secure the joint 2 and the hinge 3 together. At an upright state of both the handle 1 and the joint 2 (i.e., inoperative position), the projections 331 are urged against the shoulders 223.

A ring-shaped strand mounting assembly 5 comprises an outer annular groove 51, an inner annular flange 56, a plurality of ribs 512 for dividing the groove 51 into a plurality of arcuate sections 511, each arcuate section 511 comprising two cross-shaped apertures 52 each having four equally spaced sharp protuberances 521 and four equally spaced enhancement members 522 each adjacent the protuberance 521, and a plurality of sets of strands 54 in which each set of strands 54 has one end fastened in the arcuate section 511 after inserting through the aperture 52 to be retained by the protuberances 521. The strand mounting assembly 5 is secured to the cover 4 by snapping the arcuate sections 511 into the bottom trough 45 of the cover 4.

The cover 4 and the strand mounting assembly 5 together are adapted to rotate about the yoke 33 with the handle 1 and the yoke 33 being motionless during the rotation. In a mopping operation, a user may pivot the joint 2 a predetermined angle about the yoke 33 by turning the handle 1 with the protrusion 222 clearing the bottom of the channel 31.

Alternatively, the apertures 52 may be star-shaped or any other shapes in other embodiments.

While the invention herein disclosed has been described by means of specific embodiments, numerous modifications could be made thereto by those skilled in the art without departing from the scope and spirit of the invention set forth in the claims.

What is claimed is:

1. A mop comprising:

an elongate handle;

a joint downward projecting from the handle, the joint being formed of plastic and comprising a downward protrusion and two shoulders with the protrusion disposed therebetween;

a rotatable cover comprising an annular trough on an underside, a central through hole, and a plurality of spaced apart latches disposed between the trough and the through hole;

a hinge comprising a disc, a yoke projecting upward from the disc with a channel defined therebetween, two projections formed on a top of the yoke, and a circular plate for containing the disc, the circular plate having a plurality of spaced apart slits adjacent a circumferential edge thereof wherein the yoke passes the through hole to pivotably secure to the joint with the latches contacting a circumferential edge of the disc and inserting through the slits to secure the circular plate, the disc, and the cover together; and a ring-shaped strand mounting assembly comprising a plurality of arcuate sections each comprising at least one aperture each having at least one protuberance, and a plurality of sets of strands wherein each set of strands has one end fastened in the arcuate section after inserting through the aperture and being retained by the at least one protuberance, the strand mounting assembly being secured to the cover by snapping the arcuate sections into the trough, wherein the protrusion is urged against a bottom of the channel, and the projections are urged against the shoulders when the handle stands upright; and wherein the cover and the strand mounting assembly together are adapted to rotate about the yoke with both the handle and the yoke being motionless during the rotation.

2. The mop of claim 1, wherein each of the at least one aperture has a cross shape.

3. The mop of claim 2, wherein the number of the at least one protuberance is four, and wherein the protuberances are disposed around a center of the cross-shaped aperture.

4. The mop of claim 3, further comprising four enhancement members each disposed adjacent the protuberances.

5. The mop of claim 1, wherein each of the at least one aperture has a star shape.

* * * * *